US007123224B2

(12) United States Patent
Lee

(10) Patent No.: US 7,123,224 B2
(45) Date of Patent: Oct. 17, 2006

(54) LIQUID CRYSTAL DISPLAY AND METHOD OF MODIFYING GRAY SIGNALS FOR THE SAME

(75) Inventor: Baek-Woon Lee, Seongnam (KR)

(73) Assignee: Samsung Electronics Co., Ltd., (KR)

( * ) Notice: Subject to any disclaimer, the term of this patent is extended or adjusted under 35 U.S.C. 154(b) by 345 days.

(21) Appl. No.: 10/427,370

(22) Filed: May 1, 2003

(65) Prior Publication Data

US 2003/0210217 A1 Nov. 13, 2003

(30) Foreign Application Priority Data

May 8, 2002 (KR) ..... 10-2002-0025271

(51) Int. Cl.
*G09G 3/36* (2006.01)

(52) U.S. Cl. ..... 345/89

(58) Field of Classification Search ..... 345/87–94
See application file for complete search history.

(56) References Cited

U.S. PATENT DOCUMENTS 5,347,294 A * 9/1994 Usui et al. ..... 345/89
2001/0038372 A1* 11/2001 Lee ..... 345/89

* cited by examiner

*Primary Examiner*—Bipin Shalwala
*Assistant Examiner*—Steven Holton
(74) *Attorney, Agent, or Firm*—Cantor Colburn LLP

(57) ABSTRACT

A liquid crystal display and a method of modifying gray signals are provided. A gray signal modifier of the liquid crystal display includes a frame memory storing current gray signals and outputting previous gray signals stored therein, a case selector classifying pairs of the current gray signals and the previous gray signals into at least two groups based on characteristics of the difference between the current gray signals and the previous gray signals from the frame memory and generating corresponding signals, a lookup table outputting variables corresponding to MSBs of the current gray signals and the MSBs of the previous gray signals from the frame memory, and a calculator calculating the variables from the lookup table, LSBs of the current gray signals and the LSBs of the previous gray signals from the frame memory in a manner determined by the signals from the case selector and generating the modified gray signals. The modified gray signals for the pairs where the LSBs of the current gray signals and the LSBs of the previous gray signals are zero are predetermined, and the variables are determined in accordance with the predetermined modified gray signals. Accordingly, the modification of the current gray signal remarkably decreases modification errors and discontinuity. Also, image quality is increased by modifying the gray signal depending on the characteristics of the difference between the previous gray signal and the current gray signal.

16 Claims, 5 Drawing Sheets

LIQUID CRYSTAL DISPLAY AND METHOD OF MODIFYING GRAY SIGNALS FOR THE SAME

BACKGROUND OF THE INVENTION (a) Field of the Invention

The present invention relates to a liquid crystal display and a method of modifying gray signals for the same, and more specifically, to a liquid crystal display and a method of modifying the gray signals from a signal source.

(b) Description of the Related Art

Liquid crystal displays ("LCDs") include a pair of panels and a liquid crystal layer with dielectric anisotropy, which is disposed between the two panels. The liquid crystal layer is applied with electric field, and the transmittance of light passing through the liquid crystal layer is adjusted by controlling the electric field, thereby obtaining desired images.

LCDs are the most commonly used one of flat panel displays ("FPDs") handy to carry. Among the various types of LCDs, thin film transistor liquid crystal displays ("TFT-LCDs") employing the thin film transistors as switching elements are most widely used.

TFT-LCDs are used for a display of a television set as well as of a computer. Accordingly, it becomes increasingly important for the TFT-LCDs to implement motion pictures. However, a conventional TFT-LCD has too slow response time to implement motion pictures.

SUMMARY OF THE INVENTION

The present invention modifies gray signals for compensating the slow response time of liquid crystal.

The present invention improves image quality deterioration due to discontinuous gray changes.

A liquid crystal display according to an aspect of the present invention includes: a liquid crystal panel assembly including a plurality of pixels; a gray signal modifier classifying a plurality of pairs of current gray signals and previous gray signals from a signal source into at least two groups based on characteristics of a difference between the current gray signals and the previous gray signals and modifying the current gray signals based on a corresponding group of the at least two groups to generate a plurality of modified gray signals; and a data driver converting the modified gray signals into corresponding image signals and providing the corresponding image signals to the pixels.

Preferably, the at least two groups include a first group and a second group. The difference between the current gray signal and the previous gray signal of each pair belonging to the first group is equal to or less than a predetermined value and the difference between the current gray signal and the previous gray signal of each pair belonging to the second group is larger than the predetermined value.

The current gray signals and the previous gray signals have most significant bits ("MSBs") and least significant bits ("LSBs"). The second group preferably includes a third group and a fourth group. The LSBs of the current gray signal of each pair of the third group are larger than the LSBs of the previous gray signal of the pair of the third group, and the LSBs of the current gray signal of each pair of the fourth group are less than the LSBs of the previous gray signal of each pair of the fourth group. The current gray signals in the third group and the current gray signals in the fourth group are modified in a different manner. The third group and the fourth group include pairs of the current gray signals and the previous gray signals having the same MSBs.

The second group further includes a fifth group including pairs of the current gray signals and the previous gray signals having different MSBs, and the current gray signals of the fifth group are modified in a different manner from the current gray signals of the third and the fourth groups.

Preferably, the gray signal modifier does not modify the current gray signals of the first group.

The gray signal modifier includes: a frame memory storing the current gray signals and outputting the previous gray signals stored therein; a case selector classifying the pairs of the current gray signals and the previous gray signals into the at least two groups based on the characteristics of the difference between the current gray signals and the previous gray signals from the frame memory and generating corresponding case signals; a lookup table outputting variables corresponding to the MSBs of the current gray signals and the MSBs of the previous gray signals from the frame memory; and a calculator calculating the variables from the lookup table, the LSBs of the current gray signals and the LSBs of the previous gray signals from the frame memory in response to the case signals from the case selector and generating the modified gray signals.

Preferably, the modified gray signals for the pairs where the LSBs of the current gray signals and the LSBs of the previous gray signals are zero are predetermined, and the variables are determined in accordance with the predetermined modified gray signals.

Alternatively, the at least two groups include first to fourth groups, the first group includes pairs where the difference between the current gray signals and the previous gray signals is equal to or less than a predetermined value, the second group includes pairs where the difference between the current gray signals and the previous gray signals is larger than the predetermined value, the MSBs of the current gray signals and the MSBs of the previous gray signals are equal to each other and the LSBs of the current gray signals are larger than the LSBs of the previous gray signals, the third group includes pairs where the difference between the current gray signals and the previous gray signals is larger than the predetermined value, the MSBs of the current gray signals and the MSBs of the previous gray signals are equal to each other and the LSBs of the current gray signals are less than the LSBs of the previous gray signals, and the fourth group includes pairs where the difference between the current gray signals and the previous gray signals is larger than the predetermined value, and the MSBs of the current gray signals and the MSBs of the previous gray signals are different from each other.

The variables include f, a, b, and c defined by:

$$f(G_n[x+y-1:y],$$

$$G_{n-1}[x+y-1:y] = G'_n(G_n[x+y-1:y]\times 2_y,\ G_{n-1}[x+y-1:y]\times 2_y;$$

$$a(G_n[x+y-1:y],\ G_{n-1}[x+y-1:y] = f(G_n[x+y-1:y]+1,$$

$$G_{n-1}[x+y-1:y] - f(G_n[x+y-1:y],\ G_{n-1}[x+y-1:y];$$

$$b(G_n[x+y-1:y],\ G_{n-1}[x+y-1:y] = f(G_n[x+y-1:y],$$

$$G_{n-1}[x+y-1:y] - f(G_n[x+y-1:y],$$

$$G_{n-1}[x+y-1:y]+1);\ \text{and}\ c(G_n[x+y-1:y],$$

$$G_{n-1}[x+y-1:y] = f(G_n[x+y-1:y+1,$$

-continued $$G_{n-1}[x+y-1:y]+1)+f(G_n[x+y-1:y],$$
$$G_{n-1}[x+y-1:y]-f(G_n[x+y-1:y]+1,$$
$$G_{n-1}[x+y-1:y])-f(G_n[x+y-1:y],$$
$$G_{n-1}[x+y-1:y]+1),$$

where $G_n$ is the current gray signals, $G_{n-1}$ is the previous gray signals, x is the number of the MSBs of the previous gray signals and the current gray signals, y is the number of the LSBs of the previous gray signals and the current gray signals, and $G_n'$ is the modified gray signals.

The current gray signals of the first group are not modified.

The modified gray signals $G_n'$ for the current gray signals of the second group are calculated by the following Equation 1:

$$G_n'=f+a\times G_n[y-1:0]/2^y-b\times G_{n-1}[y-1:0]/2^y+c\times G_{n-1}[y-1:0]/2^y.$$

The modified gray signals for the current gray signals of the third group are calculated by the following Equation 2:

$$G_n'=f+a\times G_n[y-1:0]/2^y-b\times G_{n-1}[y-1:0]/2^y+c\times G_n[y-1:0]/2^y.$$

The modified gray signals for the current gray signals of the fourth group are calculated by the following Equation 3:

$$G_n'=f+a\times G_n[y-1:0]/2^y-b\times G_{n-1}[y-1:0]/2^y+c\times G_n[y-1:0]\times G_{n-1}[y-1:0]/2^{2y}.$$

A liquid crystal display according to another aspect of the present invention includes: a liquid crystal panel assembly including a plurality of pixels; a gray signal modifier modifying a plurality of current gray signals having x-bit most significant bits ("MSBs") and y-bit least significant bits ("LSBs") from a signal source based on the current gray signals and previous gray signals to output modified gray signals of the current gray signals, the previous gray signals having the x-bit MSBs and the y-bit LSBs; and a data driver converting the modified gray signals from the gray signal modifier into corresponding image signals to provide for the pixels, wherein the modified gray signals for a first group of pairs of the current gray signals and the previous gray signals are predetermined; wherein the modified gray signals for a second group of pairs of the current gray signals and the previous gray signals are determined by interpolation based on the predetermined modified gray signals; and wherein the modified gray signals for the second group of pairs are further determined by the interpolation based on the modified gray signals for at least four pairs of the first group of pairs.

A method of modifying current gray signals for a liquid crystal display according to further aspect of the present invention includes: calculating a difference between the current gray signals and the previous gray signals; classifying pairs of the current gray signals and the previous gray signals based on characteristics of the difference between the current gray signals and the previous gray signals into at least two groups; extracting most significant bits ("MSBs") of the current gray signals and the MSBs of the previous gray signals; calculating variables determined by the MSBs; extracting least significant bits ("LSBs") of the current gray signals and the LSBs of the previous gray signals; and modifying the current gray signals based on the variables and the LSBs, the modification being performed in a different manner for the respective groups.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

Then, liquid crystal displays and methods of modifying gray signals for the same according to embodiments of the present invention will be described with reference to the drawings.

Figure 1:
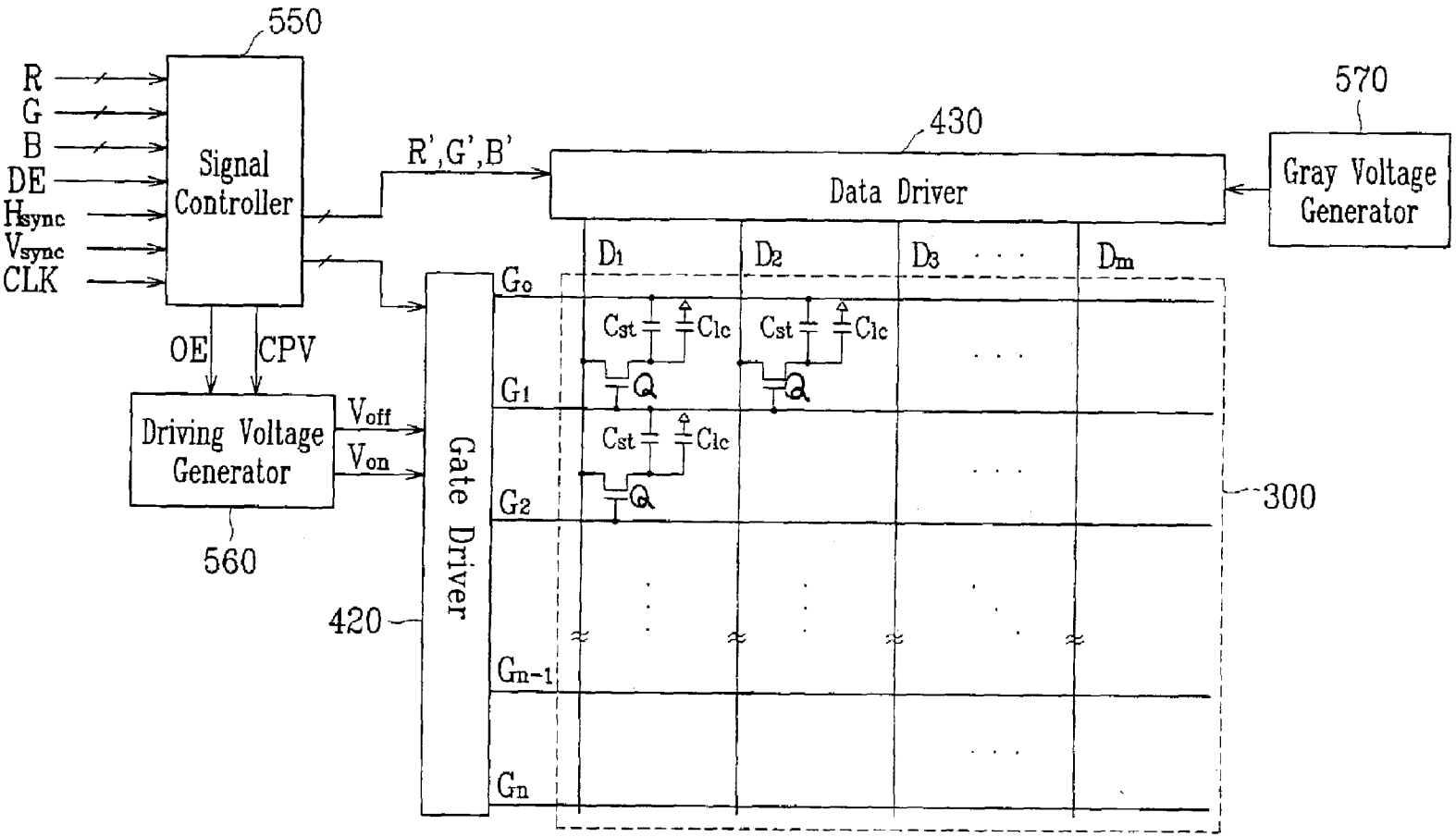
FIG. 1 is a block diagram of an LCD according to an embodiment of the present invention.
Figure 2:
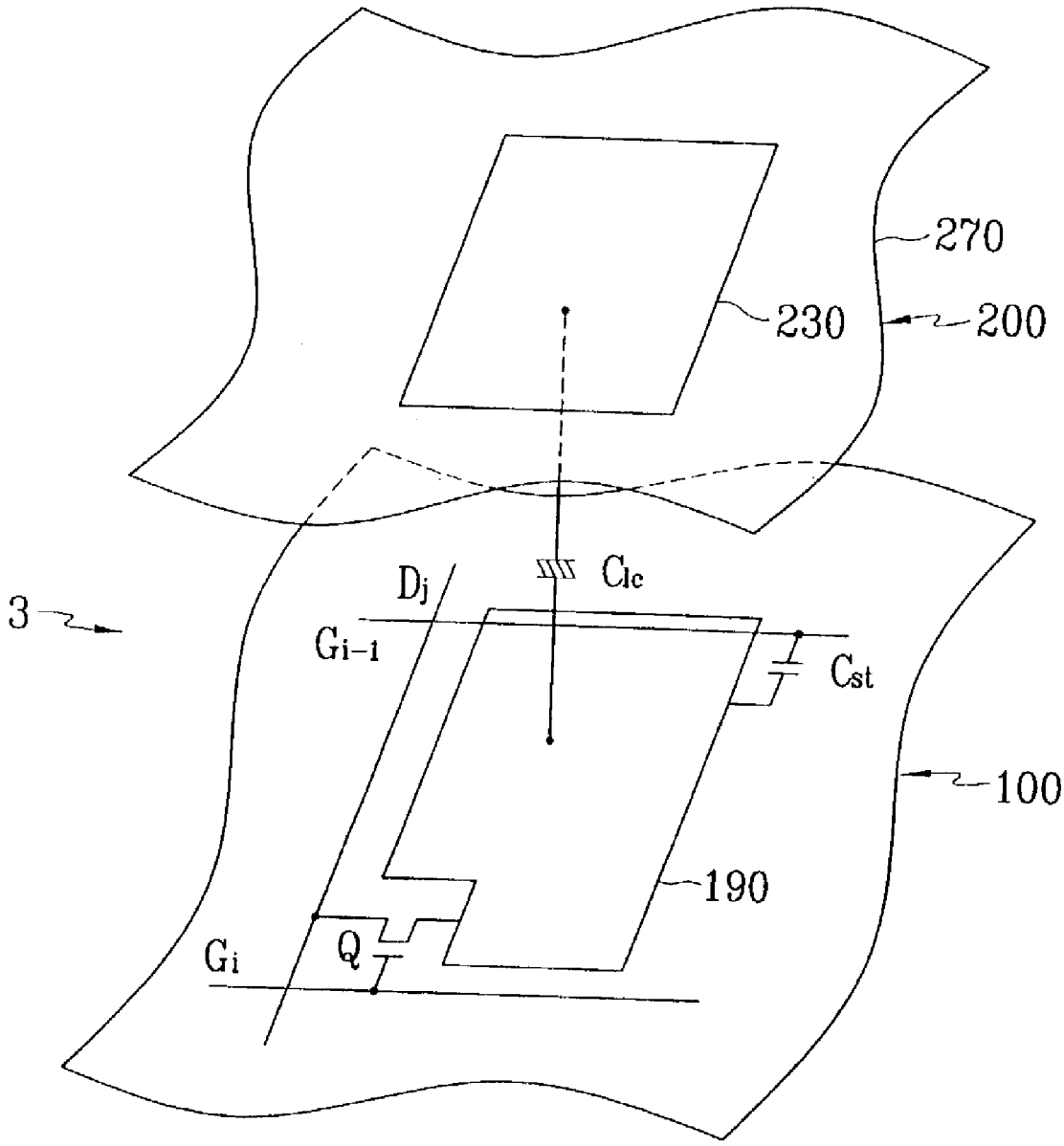
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a liquid crystal panel assembly 300, a gate driver 420 and a data driver 430 which are connected to the panel assembly 300, a driving voltage generator 560 connected to the gate driver 420, a gray voltage generator 570 connected to the data driver 430, and a signal controller 550 controlling the above elements.

The panel assembly 300 includes a plurality of signal lines $G_0$–$G_n$ and $D_1$–$D_m$ and a plurality of pixels connected thereto. Each pixel includes a switching element Q connected to the signal lines $G_0$–$G_n$ and $D_1$–$D_m$, and a liquid crystal capacitor $C_{lc}$ and a storage capacitor $C_{st}$ that are connected to the switching element Q. The signal lines $G_0$–$G_n$ include a plurality of scanning lines or gate lines extending in a row direction and transmitting scanning signals or gate signals, and the signal lines $D_1$–$D_m$ include a plurality of data lines extending in a column direction and transmitting image signals or data signals. The switching element Q has three terminals: a control terminal connected to one of the gate lines $G_0$–$G_n$, an input terminal connected to one of the data lines $D_1$–$D_m$ and an output terminal connected to both the liquid crystal capacitor $C_{lc}$ and the storage capacitor $C_{st}$.

The liquid crystal capacitor $C_{lc}$ is connected between the output terminal of the switching element Q and a reference voltage or a common voltage $V_{com}$. The storage capacitor $C_{st}$ is connected between the output terminal of the switching element Q and a previous gate line located just above (referred to as a "previous gate line"), which is referred to as a previous gate type. Alternatively, the other terminal of the storage capacitor $C_{st}$ may be connected to a predetermined voltage such as the common voltage $V_{com}$, which is referred to as a separate wire type.

FIG. 2 schematically shows a structure of a panel assembly 300 according to an embodiment of the present invention. For easy explanation, only a pixel is illustrated in FIG. 2.

As shown in FIG. 2, a panel assembly 300 includes a lower panel 100, an upper panel 200 opposite the lower panel 100 and a liquid crystal layer 3 interposed therebetween. A pair of gate lines $G_i$ and $G_{i-1}$, a data line $D_j$, a switching element Q and a storage capacitor $C_{st}$ are provided on the lower panel 100. A pixel electrode 190 on the lower panel 100 and a common electrode 270 on the upper panel 200 form two terminals of a liquid crystal capacitor $C_{lc}$. The liquid crystal layer 3 disposed between the two electrodes 190 and 270 functions as dielectric of the liquid crystal capacitor $C_{lc}$.

The pixel electrode 190 is connected to the switching element Q and the common electrode 270 is connected to the common voltage $V_{com}$ and covers entire surface of the upper panel 200. The orientations of liquid crystal molecules in the liquid crystal layer 3 are changed by the change of electric field generated by the pixel electrode 190 and the common electrode 270. The change of the molecular orientations changes the polarization of light passing through the liquid crystal layer 3, which in turn causes the variation of the transmittance of the light by a polarizer or polarizers (not shown) attached to at least one of the panels 100 and 200.

The pixel electrode 190 overlaps its previous gate line $G_{i-1}$ via an insulator to form one terminal of a storage capacitor $C_{st}$, while the previous gate line $G_{i-1}$ forms the other terminal thereof. For a separate wire type, a separate wire provided on the lower panel 100 and applied with a voltage such as the common voltage $V_{com}$ overlaps the pixel electrode 190 to form a storage capacitor $C_{st}$.

FIG. 2 shows a MOS transistor as a switching element, and the MOS transistor is implemented as a thin film transistor ("TFT") including an amorphous silicon or polysilicon channel layer in practical manufacturing process.

Alternatively, the common electrode 270 may be provided on the lower panel 100. In this case, both the electrodes 190 and 270 have shapes of stripes.

For realizing color display, each pixel can represent a color by providing one of a plurality of red, green and blue color filters 230 in an area corresponding to the pixel electrode 190. The color filter 230 shown in FIG. 2 is provided in the corresponding area of the upper panel 200. Alternatively, the color filter 230 is provided on or under the pixel electrode 190 on the lower panel 100.

Referring FIG. 1 again, the gate driver 420 and the data driver 430, which are often called a scanning driver and a source driver, respectively, may include a plurality of gate driving integrated circuits ("ICs") and a plurality of data driving ICs, respectively. The ICs are separately placed external to the panel assembly 300 or mounted on the panel assembly 300. Alternatively, the ICs may be formed on the panel assembly 300 by the same process as the signal lines $G_0$–$G_n$ and $D_1$–$D_m$ and the TFT switching elements Q.

The gate driver 420 is connected to the gate lines $G_0$–$G_n$ of the panel assembly 300 and applies gate signals from the driving voltage generator 560 to the gate lines $G_0$–$G_n$, each gate signal being a combination of a gate-on voltage $V_{on}$ and a gate off voltage $V_{off}$.

The data driver 430 is connected to the data lines $D_1$–$D_m$ of the panel assembly 300 and selects gray voltages from the gray voltage generator 570 to apply as data signals to the data lines $D_1$–$D_m$.

The gate driver 420, the data driver 430 and the driving voltage generator 560 are controlled by the signal controller 550 connected thereto and located external to the panel assembly 300. The operation will be described in detail.

The signal controller 550 is supplied with RGB gray signals R, G and B and input control signals controlling the display thereof, for example, a vertical synchronization signal $V_{sync}$, a horizontal synchronization signal $H_{sync}$, a main clock CLK, a data enable signal DE, etc, from an external graphic controller (not shown). After generating gate control signals and data control signals on the basis of the input control signals and processing the gray signals R, G and B suitable for the operation of the panel assembly 300, the signal controller 550 provides the gate control signals for the gate driver 420, and the processed gray signals R', G' and B' and the data control signals for the data driver 430. The processing of the gray signals by the signal controller 550 will be described later in detail.

The gate control signals include a vertical synchronization start signal STV for instructing to begin outputting gate-on pulses (i.e., high sections of the gate signals), a gate clock signal CPV for controlling the output period of the gate-on pulses and a output enable signal OE for defining the widths of the gate-on pulses. Among the gate control signals, the output enable signal OE and the gate clock signal CPV are provided for the driving voltage generator 560. The data control signals include a horizontal synchronization start signal STH for instructing to begin outputting the gray signals, a load signal LOAD or TP for instructing to apply the appropriate data voltages to the data lines, and a data clock signal HCLK.

Responsive to the gate control signals from the signals controller 550, the gate driver 420 sequentially applies the gate-on pulses to the gate lines $G_0$–$G_n$, thereby sequentially turning on the switching elements Q connected thereto. In response to the data control signals from the signal controller 550, the data driver 430 supplies analogue voltages from the gray voltage generator 570 in response to the gray signals R', G' and B' to the corresponding data lines $D_1$–$D_m$ as image signals. Then, the image signals in turn are applied to the corresponding pixels via the turned-on switching elements Q. By performing this procedure, all gate lines $G_0$–$G_n$ are supplied with the gate-on pulses during a frame, thereby applying the image signals to all pixel rows.

The processing of the gray signals by the signal controller 550 according an embodiment of the present invention generates a modified gray signal based on both a gray signal of a current frame (hereinafter referred to as "current gray signal") and a gray signal of a previous frame (hereinafter referred to as "previous gray signal") to compensate slow response time of liquid crystal. Such modifications of gray signals suggested by the inventor are disclosed in U.S. patent application Ser. No. 09/773,603 filed on Feb. 2, 2001, Korean Patent Application Nos. 10-2000-0005442 filed on Feb. 3, 2000 and 10-2000-0073672 filed on Dec. 6, 2000, EP Patent Application No. 01102227.4 filed on Jan. 31, 2001, Chinese Patent Application No. 01111679.X filed on Feb. 3, 2001, Japanese Patent Application No. 2001-28541 filed on Feb. 5, 2001 and Taiwanese Patent Application Nos. 89123095 filed on Nov. 2, 2000 and 90101788 filed on Jan. 30, 2001, which are incorporated herein by reference.

According to an embodiment of the present invention, a plurality of variables required for an operation are first determined by using the most significant bits ("MSB") of a previous gray signal and a current gray signal, and then a modified gray signal is calculated by using the variables and the least significant bits ("LSB") of the previous gray signal and the current gray signal.

The above procedure will be described in detail referring to FIG. 3.

For convenience, it will be assumed that a gray signal is 8-bit data and both the MSB and the LSB thereof are four bits, respectively. Accordingly, the number of gray scales or grays to be represented is $2^8=256$.

Figure 3:
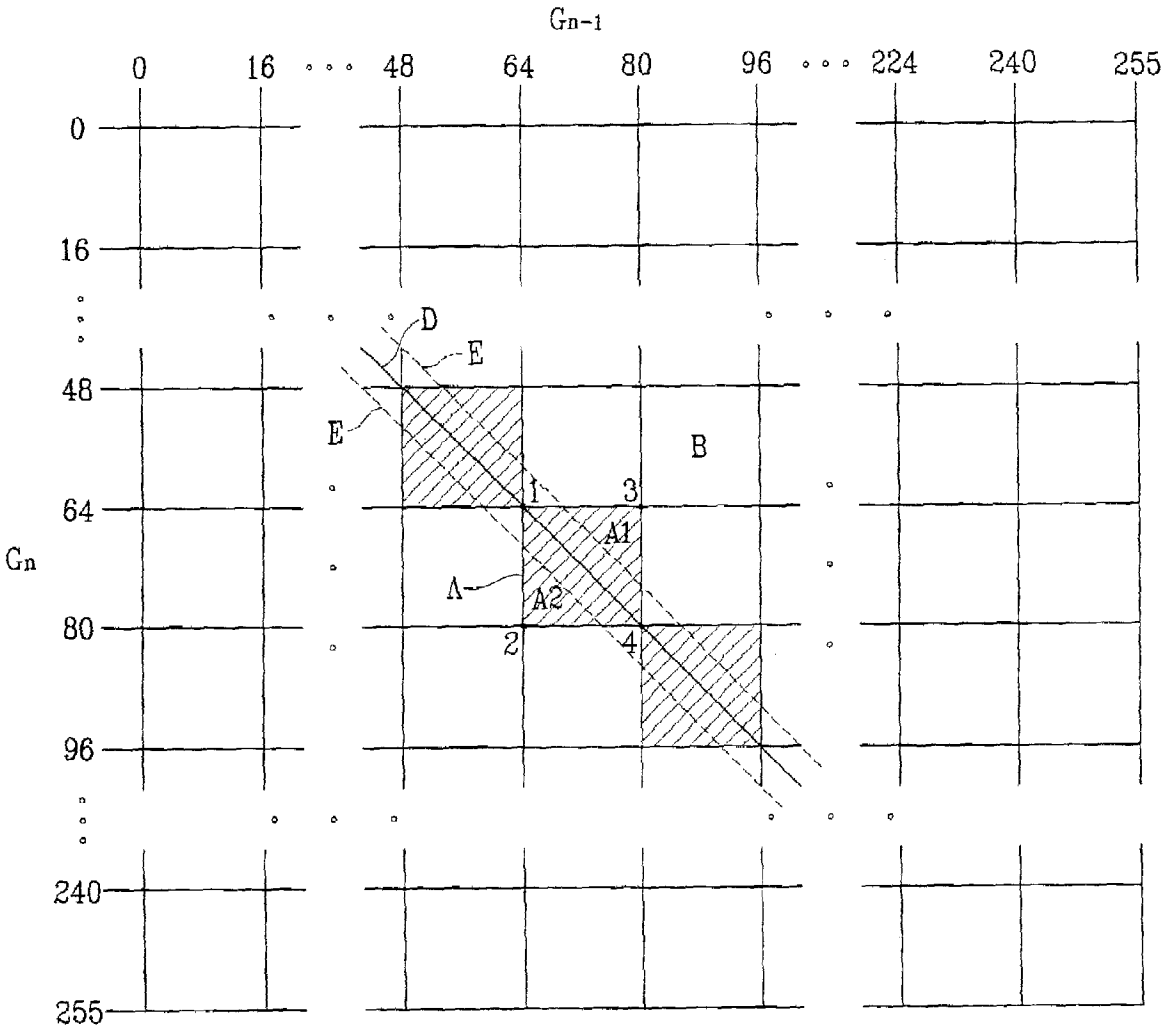
FIG. 3 illustrates a gray modifying method according to an embodiment of the present invention.

As shown in FIG. 3, the gray signals $G_n$ of the n-th frame (referred to as "current gray signals") are represented at the vertical axis and the gray signals $G_{n-1}$ of the (n-1)-th frame (referred to as "previous gray signals") are represented at the horizontal axis.

Since the number of gray scales is 256, the number of the combinations of the previous gray signals and the current gray signals is 256×256=65,536.

The gray signals to be processed are classified into appropriate groups to save time and space required for independently determining and generating modified signals for the tremendous number of all combinations.

According to an embodiment of the present invention, a plurality of blocks is defined based on the MSB values of the previous gray signals and the current gray signals, the blocks being represented as square areas enclosed by solid lines as shown in FIG. 3. Dots located at the boundaries of the blocks represent the combinations of the previous gray signals $G_{n-1}$ and the current gray signals $G_n$ at least one of which has zero LSB values. For both the previous gray signals and the current gray signals, the MSB values of the dots located within one block are equal to each other. Also, the MSB values of the dots located on the left edge and the upper edge of each block are equal to those of the dots within the block, while the MSB values of the dots on the right edge and the lower edge are different from those of dots within the block. Accordingly, a block is defined to include the dots within the block and the dots on the left edge and the upper edge of the block. For example, the MSB values of the previous gray signals $G_{n-1}$ (referred to as "previous MSB values" and represented as $G_{n-1}$[7:4]) for all the dots located in block A are [0100], and the MSB values of the current gray signals $G_n$ (referred to as the "current MSB values" and represented as $G_n$[7:4]) for those dots are also [0100]. Also, the previous MSB values for all the dots located in block B are [0101] and the current MSB values for those dots are [0011].

According to an embodiment of the present invention, modified gray signals for the dots located at the vertexes defining the blocks, that is, for the dots having zero LSB values of the previous gray signals $G_{n-1}$ and the current gray signals $G_n$ are first determined. Modified gray signals for other dots are calculated by using interpolation. The interpolation is applied to a dot in a block based on the modified gray signals for the four vertexes defining the block. Coordinates for the four vertexes are represented as follows:

The first point (1)=($G_n$[7:4], $G_{n-1}$[7:4]);

the second point (2)=($G_n$[7:4]+1, $G_{n-1}$[7:4]);

the third point (3)=($G_n$[7:4], $G_{n-1}$[7:4]+1); and the fourth point (4)=($G_n$[7:4]+1, $G_{n-1}$[7:4]+1).

The reason applying the interpolation to the dots of each block based on the four vertexes is that, for example, when the interpolation is based on the first and the second points or the first and the third points, the modified gray signals are discontinuous on the vicinity of the block boundary. However, the interpolation based on the four vertexes defining the block removes the discontinuity as in the embodiment of the present invention.

Even though the difference between the previous gray and the current gray is small, the difference may become enlarged after modification. In particular, the portion where the previous gray signals $G_{n-1}$ and the current gray signals $G_n$ are equal to each other (a diagonal D in FIG. 3) represents still images. Accordingly, even though the difference between a modified previous gray signal and a modified current gray signal is very small, the difference appears on a display panel as severe noises.

Furthermore, for example, there are portions where the difference between the previous gray signals $G_{n-1}$ and the current gray signals $G_n$ is a little such as the areas between the diagonal D and a dotted line E. Since the difference may be due to noises rather than changes of the images, the gray modification is not applied to the portions to minimize the changes of the gray scale rather than to rapidly respond to the changes of the gray scale.

Finally, modification for a portion having the diagonal D such as block A shown in FIG. 3 will be described hereinafter.

Different from the block B, the block A includes two sub-blocks A1 and A2 divided by the diagonal D. In the sub-block A1 located above the diagonal D, the current gray scale is smaller than the previous gray scale (i.e. falling). However, in the sub-block A2 located below the diagonal D, the current gray scale is larger than the previous gray scale (i.e., rising). Since characteristics of both sub-blocks A1 and A2 differ from each other, the gray modification based on the vertexes of the block similar to the other portions may result in severe errors, especially in the center of the block.

In addition, since the difference between the previous gray scale and the current gray scale in the sub-blocks A1 and A2 is small, no matter how small errors may be predominant. Therefore, the gray modification is separately performed for the respective sub-blocks A1 and A2. In this embodiment of the present invention, the interpolation for the sub-block A1 above the diagonal D is based on the first, the third and the fourth points while the interpolation for the sub-block A2 below the diagonal D is based on the first, the second and the fourth points.

The modified gray signals may be represented by the following equations. In the equations, it is assumed that x represents the bit number of the MSB, y represents the bit number of the LSB, and a modified gray signal is $G_n'$.

The modified gray signals $G_n'$ for a normal block B irrelevant to the diagonal D are expressed as the following Equation 1:

$$G_n'=f+a\times G_n[y-1:0]/2^y-b\times G_{n-1}[y-1:0]/2^y+c\times G_n[y-1:0]\times G_{n-1}[y-1:0]/2^{2y}. \quad \text{Equation 1}$$

"f" is a modified gray signal for the upper left vertex of the block B, and is expressed as the following Equation 2a:

$$f(G_n[x+y-1:y],\ G_{n-1}[x+y-1:y])=G_n'(G_n[x+y-1:y]\times 2^y,\ G_{n-1}[x+y-1:y]\times 2^y). \quad \text{Equation 2a}$$

"a" is a value of a modified gray signal for the upper left vertex subtracted from a modified gray signal for the lower left vertex in the block B, and is expressed as the following Equation 2b:

$$a(G_n[x+y-1:y],\ G_{n-1}[x+y-1:y]) = f(G_n[x+y-1:y]+1,\ G_{n-1}[x+y-1:y]) - f(G_n[x+y-1:y],\ G_{n-1}[x+y-1:y]). \quad \text{Equation 2b}$$

"b" is a value of a modified gray signal for the upper right vertex subtracted from a modified gray signal for the upper left vertex in the block B, and is expressed as the following Equation 2c:

$$b(G_n[x+y-1:y], G_{n-1}[x+y-1:y]) = f(G_n[x+y-1:y], G_{n-1}[x+y-1:y]) - f(G_n[x+y-1:y], G_{n-1}[x+y-1:y]+1). \quad \text{Equation 2c}$$

"c" is a value of modified gray signals for the lower left vertex and the upper right vertex subtracted from a sum of modified gray signals for the upper left vertex and the lower right vertex in the block B, and is expressed as the following Equation 2d:

$$c(G_n[x+y-1:y], G_{n-1}[x+y-1:y]) = f(G_n[x+y-1:y]+1, G_{n-1}[x+y-1:y]+1) + f(G_n[x+y-1:y], G_{n-1}[x+y-1:y]) - f(G_n[x+y-1:y]+1, G_{n-1}[x+y-1:y]) - f(G_n[x+y-1:y], G_{n-1}[x+y-1:y]+1). \quad \text{Equation 2d}$$

For a portion where the previous gray signals $G_{n-1}$ are almost similar to the current gray signals $G_n$, that is, for the diagonal D and the circumference thereof, for example, for a characteristic of the difference between the signals $|G_n - G_{n-1}| \leqq \alpha$ (where $\alpha$ is a predetermined constant), the modified gray signals $G_n'$ are expressed as the following Equation 3:

$$G_n' = G_n. \quad \text{Equation 3}$$

In the block A including the diagonal D, the modified gray signals $G_n'$ for the sub-block A1 where the current gray signals $G_n$ are less than the previous gray signals $G_{n-1}$ is expressed as the following Equation 4, which is made by replacing the last term "$c \times G_n[y-1:0] \times G_{n-1}[y-1:0]/2^{2y}$" of the Equation 1 with "$c \times G_n[y-1:0]/2^y$";

$$G_n' = f + a \times G_n[y-1:0]/2^y - b \times G_{n-1}[y-1:0]/2^y + c \times G_n[y-1:0]/2^y. \quad \text{Equation 4}$$

Similarly, in the block A, the modified gray signals $G_n'$ for the sub-block A2 where the current gray signals $G_n$ are larger than the previous gray signals $G_{n-1}$ are given by the following Equation 5, which is made by replacing the last term "$c \times G_n[y-1:0] \times G_{n-1}[y-1:0]/2^{2y}$" of the Equation 1 with "$c \times G_{n-1}[y-1:0]/2^y$";

$$G_n' = f + a \times G_n[y-1:0]/2^y - b \times G_{n-1}[y-1:0]/2^y + c \times G_n[y-1:0]/2^y. \quad \text{Equation 5}$$

Thus, the modified gray signals according to an embodiment of the present invention are generated by using appropriate equations depending on the characteristics of the difference between the previous gray signals and the current gray signals.

Figure 4:
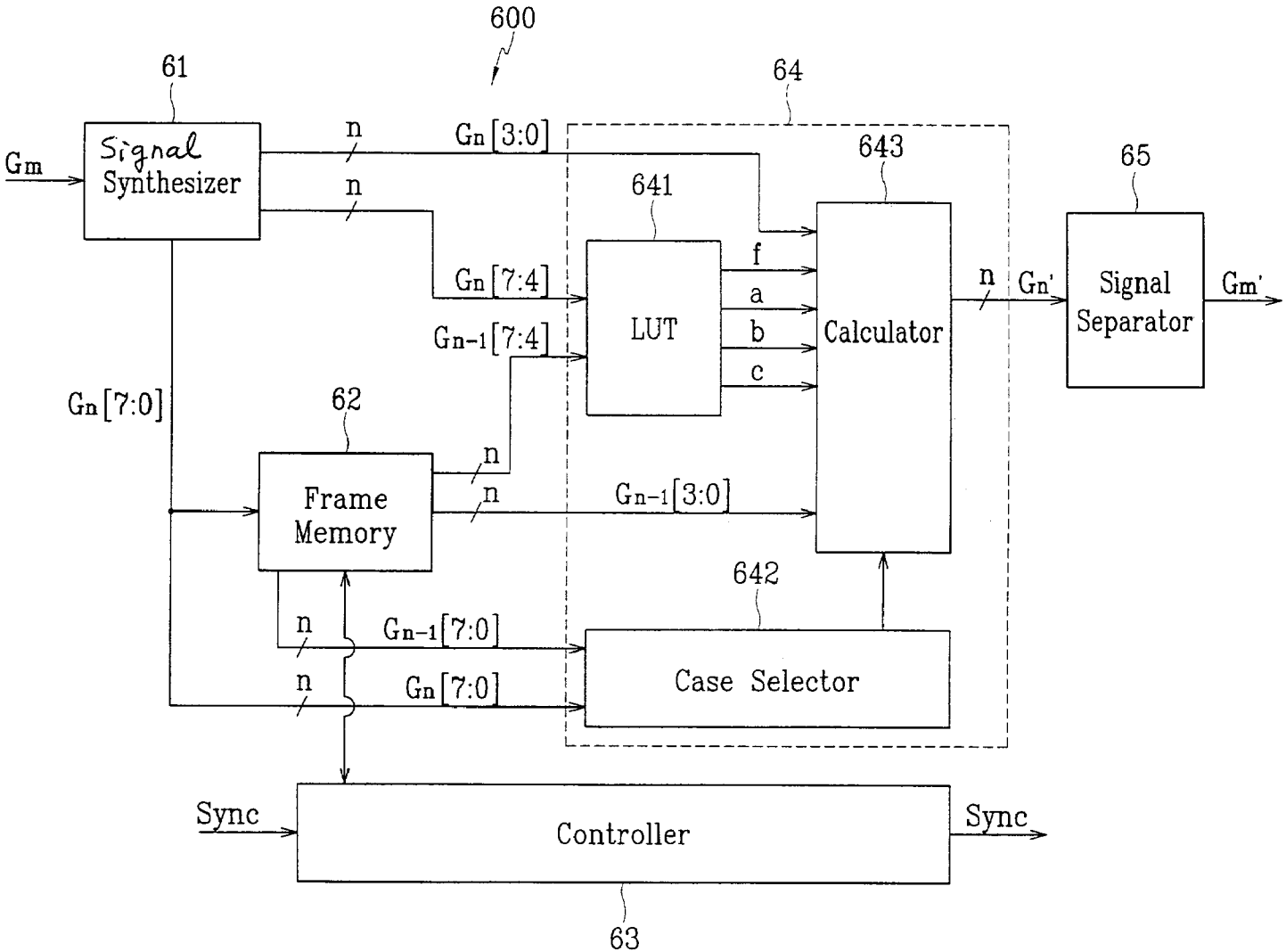
FIG. 4 is a block diagram of a gray signal modifier of an LCD according to an embodiment of the present invention.

Referring to FIG. 4, the modification of the gray signals according to an embodiment of the present invention will be described in detail.

FIG. 4 is a block diagram showing a gray signal modifier of an LCD according to an embodiment of the present invention.

As shown in FIG. 4, the gray signal modifier 600 includes a signal synthesizer 61, a frame memory 62 connected to the signal synthesizer 61, a controller 63 connected to the frame memory 62, a gray signal converter 64 connected to the signal synthesizer 61 and the frame memory 62 and a signal separator 65 connected to the gray signal converter 64.

The gray signal converter 64 includes a lookup table (LUT) 641 connected to the signal synthesizer 61 and the frame memory 62, a calculator 643 and a case selector 642. An input terminal of the calculator 643 is connected to the lookup table 641, the signal synthesizer 61 and the frame memory 62, and an output terminal of the calculator 643 is connected to the signal separator 65. An input terminal of the case selector 642 is connected to the frame memory 62 and an output terminal of the case selector 642 is connected to the calculator 643.

For convenience, a gray signal is 8-bit data, and its MSB and LSB are 4 bits, respectively. Upon receiving a gray signal $G_m$ from a signal source (not shown), the signal synthesizer 61 of the gray signal modifier 600 shown in FIG. 4 converts the frequency of the data stream of the gray signal $G_m$ so that the gray signal $G_m$ be processed by the gray signal modifier 600, for example, so that the frequency of the data stream of the gray signal $G_m$ is in synchronization with an access clock to the frame memory 62. The signal synthesizer 61 supplies the frequency-converted gray signal $G_m$ for the frame memory 62 and the gray signal converter 64. For example, if the gray signal $G_m$ with 24 bits (total bits of 8 bits of R, G and B) is inputted from the signal source with a frequency of 65 MHz and the maximum processing frequency of the components of the gray signal modifier 600 is 500 MHz, the signal synthesizer 61 synthesizes every two 24-bit gray signals $G_m$ into one 48-bit gray signal $G_n$. The signal synthesizer 61 provides the synthesized gray signal $G_n$ as a current gray signal for the frame memory 62 and the gray signal converter 64. At that time, the synthesized gray signal is divided into MSB ($G_n$[7:4]) and LSB ($G_n$[3:0]) to be supplied for the gray signal converter 64.

The controller 63 provides a previous gray signal $G_{n-1}$ stored in the frame memory 62 for the gray signal converter 64 and stores the synthesized current gray signal $G_n$ from the signal synthesizer 61 as a previous gray signal $G_{n-1}$ into the frame memory 62.

The gray signal converter 64 generates a modified gray signal $G_n'$ based on the current gray signal $G_n$ from the signal synthesizer 61 and the previous gray signal $G_{n-1}$ from the frame memory 62 and provide the modified gray signal $G_n'$ for the signal separator 65. The signal separator 65 separates the modified 48-bit gray signal $G_n'$ into and outputs two modified 24-bit gray signals $G_m'$.

The gray signals $G_n$ and $G_{n-1}$ from the signal synthesizer 61 and the frame memory 62 are divided into the MSBs ($G_n$[7:4]) and the LSBs ($G_n$[3:0]) to be supplied for the gray signal converter 64. The MSBs ($G_n$[7:4]) are provided for the lookup table 641, and the LSBs ($G_n$[3:0]) are provided for the calculator 643. Meanwhile, the gray signals $G_n$ and $G_{n-1}$ from the signal synthesizer 61 and the frame memory 62 are supplied for the case selector 642 as a whole.

As described above, four variables f, a, b and c determined by the modified gray signals for four vertexes of each block shown in FIG. 3, that is, for the case both the current LSB and the previous LSB are zero are stored in the lookup table 641 of the gray signal converter 64.

Because the gray signals are 8-bit data, and each of the MSB and the LSB is 4 bits, the variables f, a, b and c are determined as the following Equations 6a to 6d:

$$f(G_n[7:4], G_{n-1}[7:4]) = G_n'(G_n[7:4] \times 16, G_{n-1}[7:4] \times 16); \quad \text{Equation 6a}$$

$$a(G_n[7:4], G_{n-1}[7:4]) = f(G_n[7:4]+1, G_{n-1}[7:4]) - f(G_n[7:4], G_{n-1}[7:4]); \quad \text{Equation 6b}$$

$$b(G_n[7:4], G_{n-1}[7:4])=f(G_n[7:4], G_{n-1}[7:4])-f(G_n[7:4], G_{n-1}[7:4]+1); \text{ and} \quad \text{Equation 6c}$$

$$c(G_n[7:4], G_{n-1}[7:4]) = f(G_n[7:4]+1, G_{n-1}[7:4]+1)+f(G_n[7:4], G_{n-1}[7:4])-f(G_n[7:4]+1, G_{n-1}[7:4])-f(G_n[7:4], G_{n-1}[7:4]+1). \quad \text{Equation 6d}$$

Assumed that a dot belongs to the block B in FIG. 3, for example, the current gray signal $G_n$ is 51=[00110011] and the previous gray signal $G_{n-1}$ is 87=[01010111]. The current MSB ($G_n$[7:4]) is [0011]=3, the previous MSB ($G_{n-1}$[7:4]) is [0101]=5.

Accordingly, the variables f, a, b, and c are determined as the following Equations 7a to 7d:

$$f(3, 5)=G_n'(G_n=48, G_{n-1}=80) \quad \text{Equation 7a}$$

$$a(3, 5)=f(4, 5)-f(3, 5)=G_n'(G_n=64, G_{n-1}=80)-G_n'(G_n=48, G_{n-1}=80) \quad \text{Equation 7b}$$

$$b(3, 5)=f(3, 6)=G_n'(G_n=48, G_{n-1}=80)-G_n'(G_n=48, G_{n-1}=96) \quad \text{Equation 7c}$$

$$c(3, 5) = f(4, 6) + f(3, 5) - f(4, 5) - f(3, 6) = G_n'(G_n = 64, G_{n-1} = 96) + G_n'(G_n = 48, G_{n-1} = 80) - G_n'(G_n = 64, G_{n-1} = 80) - G_n'(G_n = 48, G_{n-1} = 96) \quad \text{Equation 7d}$$

The lookup table 641 fetches the variables f, a, b and c corresponding to the previous MSB and the current MSB and supplies the variables f, a, b and c for the calculator 643.

The case selector 642 selects a case signal based on the characteristic of the difference between the previous gray signal $G_{n-1}$ from the frame memory 62 and the current gray signal $G_n$ from the signal synthesizer 61. Then, the calculator 643 determines an equation in accordance with the case signal from the case selector 642 and calculates the modified gray signal $G_n'$.

The operation of the case selector 642 and the calculator 643 will be described in detail with reference to FIG. 5.

Figure 5:
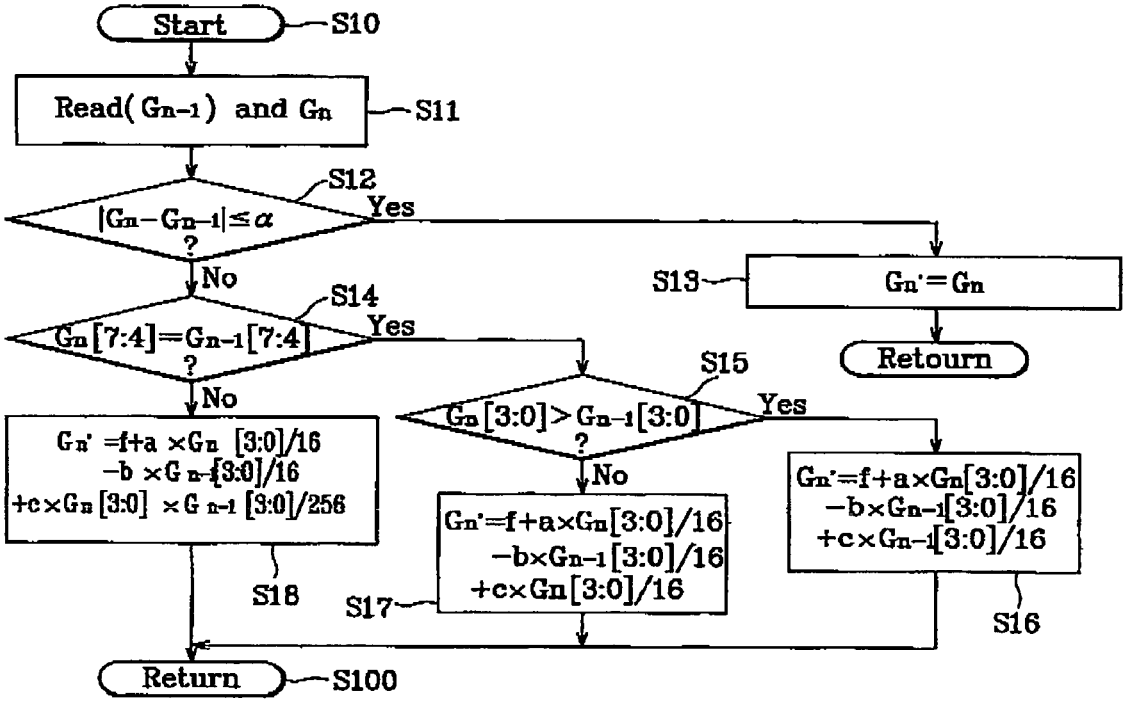
FIG. 5 is a flow chart showing a method of modifying gray signals according to an embodiment of the present invention.

FIG. 5 is a flow chart illustrating the operations of the case selector 642 and the calculator 643 according to an embodiment of the present invention.

First, upon the start of the operation (S10), the case selector 642 reads out the previous gray signal ($G_{n-1}$[7:0]) from the frame memory 62 and the current gray signal ($G_n$[7:0]) from the signal synthesizer 61 (S11).

Thereafter, the case selector 642 calculates the difference between the previous gray signal $G_{n-1}$ and the current gray signal $G_n$, and then compares the difference with a predetermined value a (S12).

At that time, the determined value α may be varied by the state of the gray signals and circumstances. In general, the value α may be set to be large under the condition that the gray signals severely experience noise, and if not, the value α may be set to be small. Preferably, the value α ranges from zero to the total number of gray scales divided by 16. For example, it is preferable that the value α for 256 total gray scales may be between 0 and 16.

After the comparison of the previous gray signal $G_{n-1}$ and the current gray signal $G_n$, when the difference is equal to or less than the predetermined value α, the case selector 642 selects and supplies a corresponding signal for the calculator 643.

Hereupon, the calculator 643 supplies the current gray signal $G_n$ as the modified gray signal $G_n'$ without modification (S13).

However, when the difference between the previous gray signal $G_{n-1}$ and the current gray signal $G_n$ is larger than the predetermined value α, the case selector 642 determines whether or not the previous MSB ($G_{n-1}$[7:4]) is equal to the current MSB ($G_n$[7:4]) (S14).

If the previous MSB ($G_{n-1}$[7:4]) and the current MSB ($G_n$[7:4]) are equal to each other, the case selector 642 compares the previous LSB ($G_{n-1}$[3:0]) with the current LSB ($G_n$[3:0]) (S15). When the current LSB ($G_n$[3:0]) is larger than the previous LSB ($G_{n-1}$[3:0]), the case selector 642 supplies a corresponding case signal for the calculator 643.

Accordingly, the calculator 643 selects the Equation 5 and applies the variables f, a, b, and c fetched in the lookup table 641, the previous LSB ($G_{n-1}$[3:0]) and the current LSB ($G_n$[3:0]) to the Equation 5 to calculate the modified gray signal $G_n'$ (S16). The modified gray signal $G_n'$ is as follows:

$$G_n'=f+a\times G_n[3:0]/2^4-b\times G_{n-1}[3:0]/2^4+c\times G_{n-1}[3:0]/2^4.$$

However, if the current LSB ($G_n$[3:0]) is less than the previous LSB ($G_{n-1}$[3:0]), the case selector 642 supplies a corresponding signal for the calculator 643 (S17). The calculator 643 selects the Equation 4 and applies the variables f, a, b, and c fetched in the lookup table 641, the previous LSB ($G_{n-1}$[3:0]) and the current LSB ($G_n$[3:0]) to the Equation 4 to calculate the modified gray signal $G_n'$ (S17). The modified gray signal $G_n'$ is as follows:

$$G_n'=f+a\times G_n[3:0]/2^4-b\times G_{n-1}[3:0]/2^4+c\times G_n[3:0]/2^4.$$

When the determination result in the step S14 is "No", that is, the MSB ($G_n$[7:4] is not equal to the MSB($G_{n-1}$[7:40]), the case selector 642 supplies a corresponding signal for the calculator 643.

Accordingly, the calculator 643 selects the Equation 1 and applies variables f, a, b, and c, the previous LSB ($G_{n-1}$[3:0]) and the current LSB ($G_n$[3:0]) to the Equation 1 to calculate the modified gray signal $G_n'$ (S18). The modified gray signal $G_n'$ is as follows:

$$G_n'=f+a\times G_n[3:0]/2^4-b\times G_{n-1}[3:0]/2^4+c\times G_n[3:0]\times G_{n-1}[3:0]/2^8.$$

Then, the process returns to the start (S100).

In accordance with above manners, the gray signal converter 64 calculates the modified gray signal $G_n'$ by using appropriate equations based on the characteristic of the difference between the previous gray signal $G_{n-1}$ and the current gray signal $G_n$ and supplies the modified gray signal $G_n'$ for the signal separator 65.

In this embodiment of the present invention, because the clock frequency in synchronization with the gray signal is different from the clock frequency accessing the frame memory 62, the signal synthesizer 61 and the signal separator 65 synthesizing and separating the gray signal, respectively, is needed. However, when two frequencies are equal to each other, the signal synthesizer 61 and the signal separator 65 is unnecessary.

The gray signal converter 64 in accordance with this embodiment of the present invention includes a lookup table, stores the table in a ROM (read only memory), and accesses the ROM to calculate the equations. However, it is possible to manufacture and use a digital circuit calculating the equations.

The gray signal converter 64 according to this embodiment of the present invention is represented as a part of the signal controller 550, but may be manufactured as a stand-alone device separated from the signal controller 550. In this case, the gray signal converter 64 may be included in an external graphic controller.

As described above, the modification of the current gray signal in the liquid crystal display according to the embodiments of the present invention remarkably decreases modification errors and discontinuity. Also, image quality is increased by modifying the gray signal depending on the characteristics of the difference between the previous gray signal and the current gray signal.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a liquid crystal panel assembly including a plurality of pixels;

a gray signal modifier classifying a plurality of pairs of current gray signals and previous gray signals into at least two groups based on characteristics of a difference between the current gray signals and the previous gray signals and modifying the current gray signals based on a corresponding group of the at least two groups to generate a plurality of modified gray signals;

wherein the gray signal modifier comprises:

a frame memory storing the current gray signals and outputting the previous gray signals stored therein;

a case selector classifying the pairs of the current gray signals and the previous gray signals into the at least two groups based on the characteristics of the difference between the current gray signals and the previous gray signals from the frame memory and generating corresponding case signals;

a lookup table outputting variables corresponding to the MSBs of the current gray signals and the MSBs of the previous gray signals from the frame memory; and a calculator calculating the variables from the lookup table, the LSBs of the current gray signals and the LSBs of the previous gray signals from the frame memory in response to the case signals from the case selector and generating the modified gray signals; and a data driver converting the modified gray signals into corresponding image signals and providing the corresponding image signals to the pixels;

wherein the current gray signals and the previous gray signals have most significant bits ("MSBs") and least significant bits ("LSBs"); and wherein the modified gray signals for the pairs where the LSBs of the current gray signals and the LSBs of the previous gray signals are zero are predetermined, and the variables are determined in accordance with the predetermined modified gray signals.

2. The liquid crystal display of claim 1, wherein the at least two groups comprise first to fourth groups; and wherein the first group includes pairs where the difference between the current gray signals and the previous gray signals is equal to or less than a predetermined value;

the second group includes pairs where the difference between the current gray signals and the previous gray signals is larger than the predetermined value, the MSBs of the current gray signals and the MSBs of the previous gray signals are equal to each other and the LSBs of the current gray signals are larger than the LSBs of the previous gray signals;

the third group includes pairs where the difference between the current gray signals and the previous gray signals is larger than the predetermined value, the MSBs of the current gray signals and the MSBs of the previous gray signals are equal to each other and the LSBs of the current gray signals are less than the LSBs of the previous gray signals; and the fourth group includes pairs where the difference between the current gray signals and the previous gray signals is larger than the predetermined value, and the MSBs of the current gray signals and the MSBs of the previous gray signals are different from each other.

3. The liquid crystal display of claim 2, wherein the variables comprise f, a, b, and c, $$f(G_n[x+y-1:y], G_{n-1}[x+y-1:y]) = G'_n(G_n[x+y-1:y]\times 2_y, G_{n-1}[x+y-1:y]\times 2_y,$$

$$a(G_n[x+y-1:y], G_{n-1}[x+y-1:y]) = f(G_n[x+y-1:y]+1, G_{n-1}[x+y-1:y] - f(G_n[x+y-1:y], G_{n-1}[x+y-1:y],$$

$$b(G_n[x+y-1:y], G_{n-1}[x+y-1:y]) = f(G_n[x+y-1:y], G_{n-1}[x+y-1:y = f(G_n[x+y-1:y], G_{n-1}[x+y-1:y]+1),$$

$$\text{and } c(G_n[x+y-1:y], G_{n-1}[x+y-1:y]) = f(G_n[x+y-1:y]+1, G_{n-1}[x+y-1:y]+1) + f(G_n[x+y-1:y], G_{n-1}[x+y-1:y]) - f(G_n[x+y-1:y]+1, G_{n-1}[x+y-1:y]) - f(G_n[x+y-1:y], G_{n-1}[x+y-1:y]+1),$$

where $G_n$ is the current gray signals, $G_{n-1}$ is the previous gray signals, x is the number of the MSBs of the previous gray signals and the current gray signals, y is the number of the LSBs of the previous gray signals and the current gray signals, and $G_n'$ is the modified gray signals.

4. The liquid crystal display of claim 3, wherein the modified gray signals of the current gray signals of the first group are generated without modifying the current gray signals.

5. The liquid crystal display of claim 3, wherein the modified gray signals of the current gray signals of the second group are calculated by the following Equation 1:

$$G_n' = f + a\times G_n[y-1:0]/2^y - b\times G_{n-1}[y-1:0]/2^y + c\times G_{n-1}[y-1:0]/2^y.$$

6. The liquid crystal display of claim 3, wherein the modified gray signals of the current gray signals of the third group are calculated by the following Equation 2:

$$G_n' = f + a\times G_n[y-1:0]/2^y - b\times G_{n-1}[y-1:0]/2^y + c\times G_n[y-1:0]/2^y.$$

7. The liquid crystal display of claim 3, wherein the modified gray signals of the current gray signals of the fourth group are calculated by the following Equation 3:

$$G_n' = f + a\times G_n[y-1:0]/2^y - b\times G_{n-1}[y-1:0]/2^y + c\times G_n[y-1:0]\times G_{n-1}[y-1:0]/2^{2y}.$$

8. A liquid crystal display comprising:

a liquid crystal panel assembly including a plurality of pixels;

a gray signal modifier classifying a plurality of pairs of current gray signals and previous gray signals into at least two groups based on characteristics of a difference between the current gray signals and the previous gray signals and modifying the current gray signals based on a corresponding group of the at least two groups to generate a plurality of modified gray signals, wherein the gray signal modifier comprises:

a frame memory storing the current gray signals and outputting the previous gray signals stored therein;

a case selector classifying the pairs of the current gray signals and the previous gray signals into the at least two groups based on the characteristics of the difference between the current gray signals and the previous gray signals from the frame memory and generating corresponding case signals;

a lookup table outputting variables corresponding to the MSBs of the current gray signals and the MSBs of the previous gray signals from the frame memory; and a calculator calculating the variables from the lookup table, the LSBs of the current gray signals and the LSBs of the previous gray signals from the frame memory in response to the case signals from the case selector and generating the modified gray signals; and a data driver converting the modified gray signals into corresponding image signals and providing the corresponding image signals to the pixels;

wherein the current gray signals and the previous gray signals have most significant bits ("MSBs") and least significant bits ("LSBs"); and wherein the gray signal modifier further comprises a signal synthesizer for synchronizing a data stream of the current gray signals with an access clock to the frame memory; and a signal separator for separating the modified gray signals.

9. The liquid crystal display of claim 8, wherein the gray signal modifier further comprises a controller for storing the current gray signals as previous gray signals in the frame memory and for providing the previous gray signals stored in the frame memory to the case selector and the look up table.

10. A liquid crystal display comprising:

a liquid crystal panel assembly including a plurality of pixels;

a gray signal modifier modifying a plurality of current gray signals having x-bit most significant bits ("MSBs") and y-bit least significant bits ("LSBs") from a signal source based on the current gray signals and previous gray signals to output modified gray signals of the current gray signals, the previous gray signals having the x-bit MSBs and the y-bit LSBs; and a data driver converting the modified gray signals from the gray signal modifier into corresponding image signals to provide for the pixels;

wherein the modified gray signals for a first group of pairs of the current gray signals and the previous gray signals are predetermined;

wherein the modified gray signals for a second group of pairs of the current gray signals and the previous gray signals are determined by interpolation based on the predetermined modified gray signals for the first group of pairs; and wherein the modified gray signals for the second group of pairs are further determined by the interpolation based on the modified gray signals for at least four pairs of the first group of pairs.

11. The liquid crystal display of claim 10, wherein the LSBs of the current gray signals and the LSBs of the previous gray signals of the at least four pairs include are zero; and wherein the at least four pairs include:

$$(G_n[x+y-1:x],\ G_{n-1}[x+y-1:x]),\ (G_{n-1}[x+y-1:x]+1,\ G_{n-1}[x+y-1y]),$$

$$(G_n[x+y-1:x],\ G_{n-1}[x+y-1:x]+1),\ \text{and}\ (G_{n-1}[x+y-1:y]+1,\ G_{n-1}[x+y-1:x]+1),$$

where $G_n$ is the current gray signals, $G_{n-1}$ is the previous gray signals, x is the bit number of the MSBs of the previous and the current gray signals, y is the bit number of the LSB of the previous and the current gray signals, the MSBs and the LSBs of the current gray signals are $G_n([x+y-1:y])$ and $G_n([y-1:0])$, respectively, and the MSBs and the LSBs of the previous gray signals are $G_{n-1}([x+y-1:y])$ and $G_{n-1}([y-1:0])$, respectively.

12. The liquid crystal display of claim 11, wherein the modified gray signals for the at least four pairs are given by the following Equations:

$$G_n' = f + a \times G_n[y-1:0]/2^y - b \times G_{n-1}[y-1:0]/2^y + c \times G_n[y-1:0] \times G_{n-1}[y-1:0]/2^{2y}.$$

where $$f(G_n[x+y-1:y],\ G_{n-1}[x+y-1:y]) = G_n'(G_n[x+y-1:y] \times 2_y,\ G_{n-1}[x+y-1:y] \times 2_y),$$

$$a(G_n[x+y-1:y],\ G_{n-1}[x+y-1:y]) = f(G_n[x+y-1:y]+1,\ G_{n-1}[x+y-1:y]) - f(G_n[x+y-1:y],\ G_{n-1}[x+y-1:y]),$$

$$b(G_n[x+y-1:y],\ G_{n-1}[x+y-1:y]) = f(G_n[x+y-1,\ y],\ G_{n-1}[x+y-1:y]) - f(G_n[x+y-1:y],\ G_{n-1}[x+y-1:y]+1),$$

$$\text{and}\ c(G_n[x+y-1:y],\ G_{n-1}[x+y-1:y]) = f(G_n[x+y-1:y]+1,\ G_{n-1}[x+y-1:y]+1) + f(G_n x+y-1:y],\ G_{n-1}[x+y-1:y]) - f(G_n[x+y-1:y]+1,\ G_{n-1}[x+y-1:y]) - f(G_n[x+y-1:y],\ G_{n-1}[x+y-1:y]+1),$$

where $G_n'$ is the modified gray signals, x is the number of the MSB of the previous gray signals and the current gray signals, y is the number of the LSB of the previous gray signals and the current gray signals.

13. A method of modifying current gray signals for a liquid crystal display, the method comprising:

calculating a difference between the current gray signals and previous gray signals;

classifying pairs of the current gray signals and the previous gray signals based on characteristics of the difference between the current gray signals and the previous gray signals into at least two groups;

extracting most significant bits ("MSBs") of the current gray signals and the MSBs of the previous gray signals;

calculating variables determined by the MSBs;

extracting least significant bits ("LSBs") of the current gray signals and the LSBs of the previous gray signals; and modifying the current gray signals based on the variables and the LSBs, the modification being performed in a different manner for the respective groups.

14. The method of claim 13, wherein the at least two groups comprise first to fourth groups; and wherein the first group includes pairs where the difference between the current gray signals and the previous gray signals is equal to or less than a predetermined value;

the second group includes pairs where the difference between the current gray signals and the previous gray signals is larger than the predetermined value, the MSBs of the current gray signals and the MSBs of the previous gray signals are equal to each other and the LSBs of the current gray signals are larger than the LSBs of the previous gray signals;

the third group includes pairs where the difference between the current gray signals and the previous gray signals is larger than the predetermined value, the MSBs of the current gray signals and the MSBs of the previous gray signals are equal to each other and the LSBs of the current gray signals are less than the LSBs of the previous gray signals; and the fourth group includes pairs where the difference between the current gray signals and the previous gray signals is larger than the predetermined value and the MSBs of the current gray signals and the MSBs of the previous gray signals are different from each other.

15. The method of claim 14, wherein the variables comprise f, a, b, and c defined by:

$$f(G_n[x+y-1:y], G_{n-1}[x+y-1:y] = G'_n(G_n[x+y-1:y]\times 2_y, G_{n-1}[x+y-1:y]\times 2_y), a(G_n[x+y-1:y], G_{n-1}[x+y-1:y] = f(G_n[x+y-1:y]+1, G_{n-1}[x+y-1:y]) - f(G_n[x+y-1:y], G_{n-1}[x+y-1:y], b(G_n[x+y-1:y],$$

-continued $$G_{n-1}[x+y-1:y] = f(G_n[x+y-1:y], G_{n-1}[x+y-1:y] - f(G_n[x+y-1:y], G_{n-1}[x+y-1:y]+1),$$

$$\text{and } c(G_n[x+y-1:y], G_{n-1}[x+y-1:y] = f(G_n[x+y-1:y]+1, G_{n-1}[x+y-1:y]+1) + f(G_n[x+y-1:y], G_{n-1}[x+y-1:y]) - f(G_n[x+y-1:y]+1, G_{n-1}[x+y-1:y]) - f(G_n[x+y-1:y], G_{n-1}[x+y-1:y]+1),$$

where $G_n$ is the current gray signals, $G_{n-1}$ is the previous gray signals, $G_n'$ is the modified gray signals, x is the bit number of the MSBs of the previous gray signals and the current gray signals, y is the bit number of the LSBs of the previous gray signals and the current gray signals.

16. The method of claim 15, wherein the current gray signals of the first group are not modified;

the modified gray signals for the current gray signals of the second group are calculated by the following Equation 1:

$$G_n' = f + a\times G_n[y-1:0]/2^y - b\times G_{n-1}[y-1:0]/2^y + c\times G_{n-1}[y-1:0]/2^y.$$

the modified gray signals for the current gray signals of the third group are calculated by the following Equation 2:

$$G_n' = f + a\times G_n[y-1:0]/2^y - b\times G_{n-1}[y-1:0]/2^y + c\times G_n[y-1:0]/2^y; \text{ and}$$

the modified gray signals for the current gray signals of the fourth group are calculated by the following Equations 3:

$$G_n' = f + a\times G_n[y-1:0]/2^y - b\times G_{n-1}[y-1:0]/2^y + c\times G_n[y-1:0]\times G_{n-1}[y-1:0]/2^{2y}.$$

* * * * *